United States Patent [19]

Burns

[11] 4,142,451

[45] Mar. 6, 1979

[54] VIBRATOR

[76] Inventor: Cameron A. Burns, 615 Catalina Way, Modesto, Calif. 95350

[21] Appl. No.: 793,427

[22] Filed: May 3, 1977

[51] Int. Cl.[2] ..... F01B 13/06; E01C 19/38; B06B 1/16

[52] U.S. Cl. ..... 91/491; 404/117; 74/87

[58] Field of Search ..... 74/87; 91/491, 497, 91/498; 417/312; 404/117

[56] References Cited

U.S. PATENT DOCUMENTS

| | | | |
|---|---|---|---|
| 1,207,239 | 12/1916 | Templin | 417/312 |
| 2,862,455 | 12/1958 | Ferris | 91/498 |
| 3,400,913 | 9/1968 | Matson | 74/87 |
| 3,426,695 | 2/1969 | Klaus | 91/498 |
| 3,623,407 | 11/1969 | Dresher | 404/117 |
| 3,780,624 | 12/1973 | Webb | 91/498 |
| 3,854,284 | 12/1974 | Dealler | 91/501 |
| 3,905,204 | 9/1975 | Edwards | 417/312 |

FOREIGN PATENT DOCUMENTS

| | | | |
|---|---|---|---|
| 856236 | 6/1940 | France | 91/497 |
| 875334 | 11/1959 | United Kingdom | 74/87 |

*Primary Examiner*—William L. Freeh

*Attorney, Agent, or Firm*—Clarence A. O'Brien; Harvey B. Jacobson

[57] ABSTRACT

A housing is provided defining a central cavity and a rotor is journaled within the cavity and includes at least one piston bore formed therein extending generally radially of the axis of rotation of the rotor. The bore opens outwardly of the periphery of the rotor and a piston is reciprocal in the bore. The cavity defines at least one pair of approach and departure ramp surfaces extending thereabout in registry with which the outer end of the bore swings upon rotation of the rotor and the piston includes anti-friction thrust means on the end thereof remote from the axis of rotation of the rotor engageable with the ramp surfaces. Inlet and outlet means are provided and operative to admit fluid under pressure into the inner end of the bore and to exhaust fluid from the inner end of the bore in timed relation with rotation of the rotor as the thrust means swings into position engaged with the beginning of the departure and approach ramp surfaces, respectively.

13 Claims, 10 Drawing Figures

VIBRATOR

BACKGROUND OF THE INVENTION

Various forms of vibrators, including eccentrically weighted rotors have been heretofore provided. However, most vibrators of this type are not constructed whereby they receive their power from a source of compressed gas. Further, most rotary vibrators which are powered by air motors utilize van-type motors and require excessive amounts of compressed air in order to develop reasonable torque.

Examples of various forms of vibrators are disclosed in U.S. Pat. Nos. 1,615,052, 2,025,703, 3,598,029, 3,623,407 and 3,814,533.

BRIEF DESCRIPTION OF THE INVENTION

The vibrator of the instant invention includes an eccentrically weighted rotor and the rotor is provided with generally radial bores having pistons reciprocal therein. The rotor is journaled within a housing defining a cavity including at least one pair of approach and departure ramp surfaces extending thereabout and fluid inlet and outlet structure is provided for admitting fluid under pressure and exhausting fluid under pressure from the inner ends of the piston bores in timed relation with rotation of the rotor, whereby the admission of gas under pressure into the inner ends of the bores will cause the pistons therein to be forced outwardly against the departure ramp surfaces to thus generate rotational torque of the rotor of the vibrator.

The main object of this invention is to provide a vibrator of the fluid pressure actuated type including an eccentrically weighted power rotor.

A further object is to provide a vibrator which may be utilized singly or in tandem and which includes structure capable of developing considerable torque as a result of being supplied with a minimum volume of fluid under pressure.

Another object of this invention is to provide a vibrator which may be readily utilized in numerous environments.

A still further object of this invention is to provide a vibrator of the pressurized gas driven type and including a minimum of relatively movable components.

Another important object of this invention is to provide a vibrator, in accordance with the preceding objects, and which may be readily disassembled for maintenance thereon.

Another object of this invention is to provide a structure in accordance with the preceding objects and which may be equipped with a balanced rotor and a torque output shaft with a minimum of modifications thereto so as to provide a fluid motor.

A still further object of this invention is to provide a rotary fluid actuated apparatus which may be readily modified to develop various amounts of rotational torque.

Still another object of this invention is to provide a rotary fluid pressure motor which may be readily modified to operate in reversed directions.

Still another object of this invention is to provide a rotary fluid pressure operated vibrator-motor including an improved sound muffling construction for the exhaust thereof.

A further object of this invention is to provide a rotary vibrator-motor which may be readily constructed of various sizes.

Another important object of this invention is to provide a rotary fluid pressure actuated vibrator-motor dependent more heavily on the pressure of the actuating fluid therefore as opposed to the volume of pressurized fluid supplied thereto in order to develop rotary torque.

A final object of this invention to be specifically enumerated herein is to provide a rotary vibrator-motor, in accordance with the preceding objects, and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein the like numerals refer to like parts throughout.

DETAILED DESCRIPTION OF THE INVENTION

Figure 1:
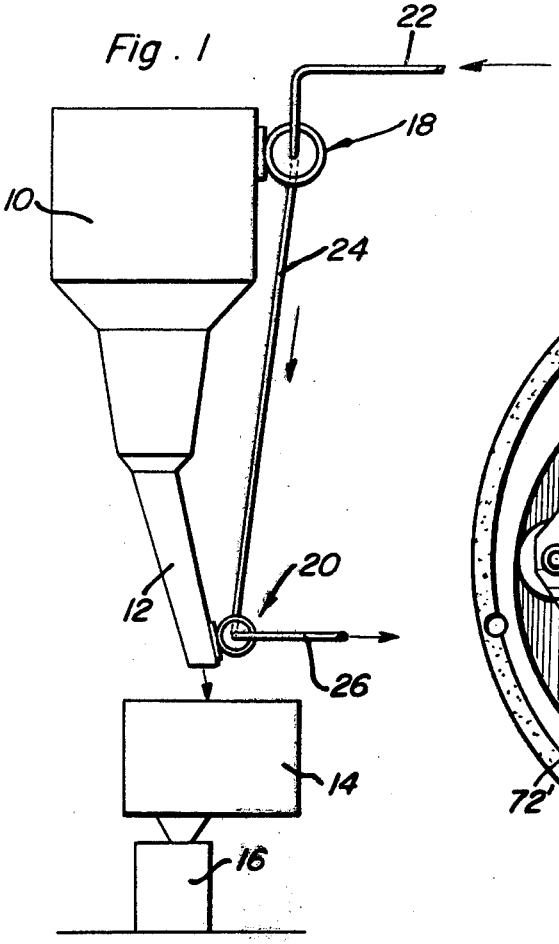
FIG. 1 is a schematic view illustrating a typical usage of the rotary vibrator of the instant invention.

Referring now more specifically to the drawings and to FIG. 1 in particular, the numeral 10 generally designates a granular or powder material hopper including a lower outlet spout 12 opening downwardly into a bagging machine 14 whose purpose it is to sequentially fill a plurality of bags 16 with the material (not shown) within the hopper 10. A first rotary vibrator referred to in general by the reference numeral 18 is mounted on the hopper 10 for vibrating the latter and a second smaller rotary vibrator referred to in general by the reference numeral 20 is mounted on the spout 12 for vibrating the spout 12. The vibrators 18 and 20 serve to insure a continuous and even flow of granular or powered material from the hopper into the spout 12 and from the spout 12 into the bagging machine 14. In this manner, the bagging machine 14 will be capable of depositing equal amounts of granular or powered material from the hopper 10 into each bag 16.

The rotary vibrator 18 is powered by air under pressure delivered thereto through a supply line 22 and the exhaust from the vibrator 18 is piped through a second line 24 to the inlet of the second vibrator 20. Thereafter, the fluid under pressure from the vibrator 20 is exhausted therefrom by means of a line 26.

Figure 4:
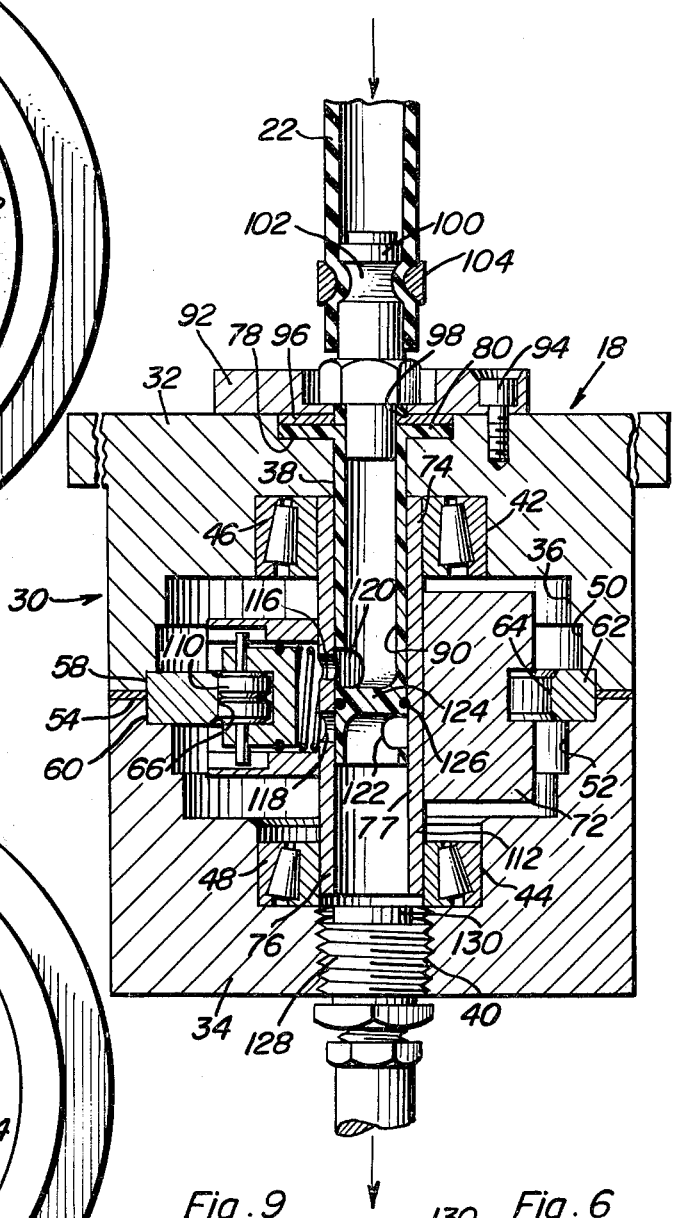
FIG. 4 is a longitudinal, section view of the vibrator.
Figure 5:
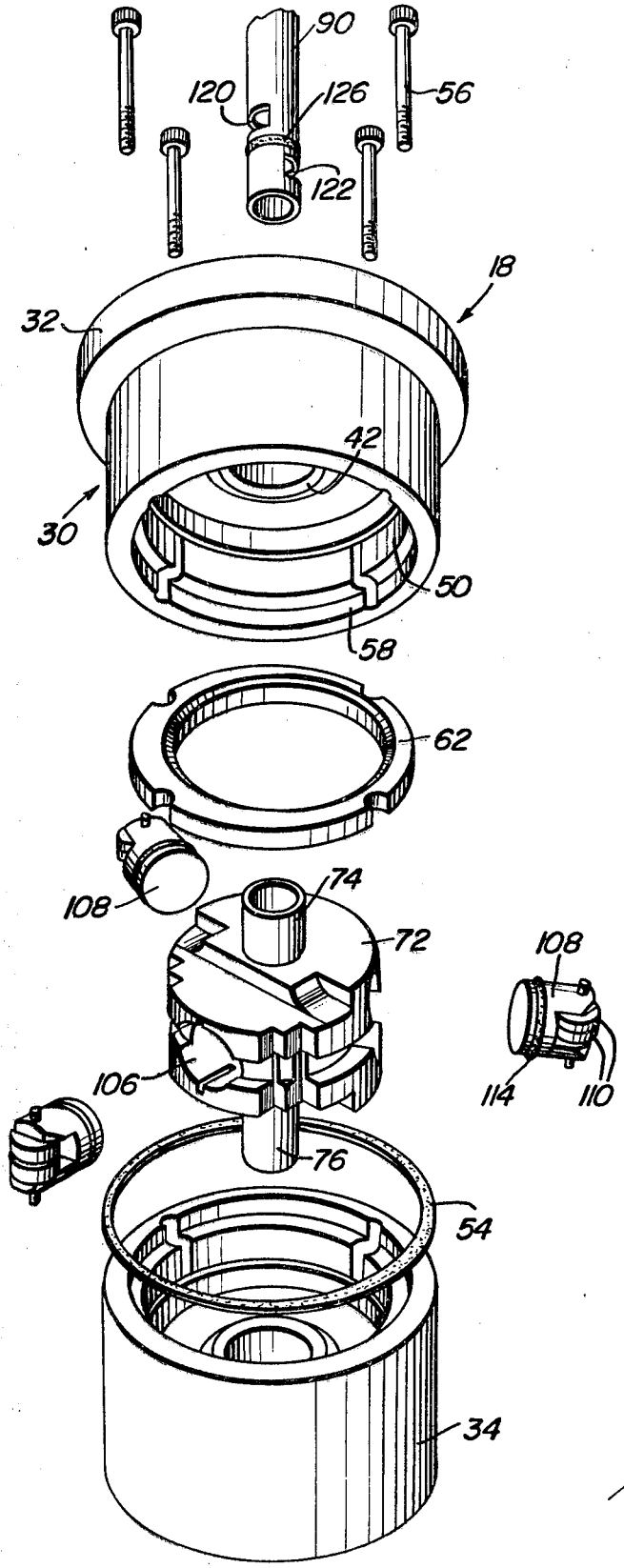
FIG. 5 is an exploded, perspective view of the rotary vibrator with the fluid inlet structure thereof partial broken away.

Each of the vibrators 18 and 20 is similarly constructed. As may best be seen from FIGS. 4 and 5 of the drawings, the vibrator 18 includes a housing referred to in general by the reference numeral 30. The housing 30 includes opposite end halves 32 and 34 and defines a center cavity 36 therein.

Figure 3:
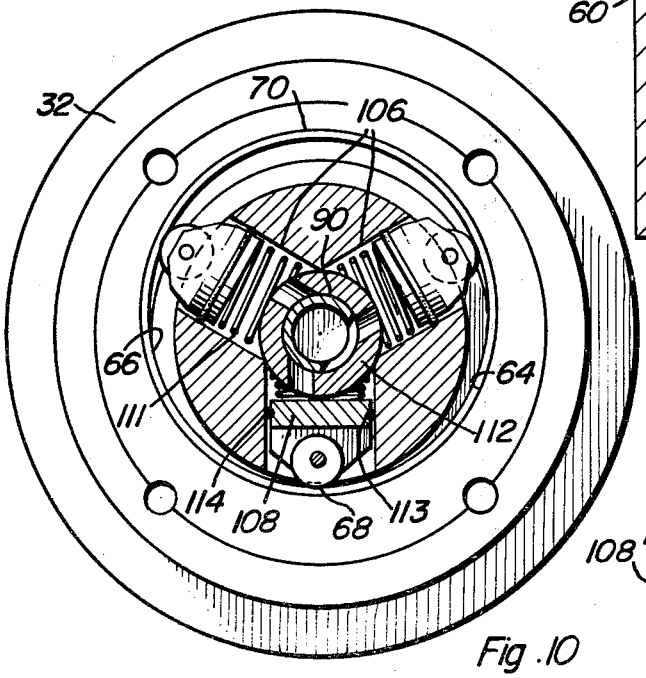
FIG. 3 is an end elevational view similar to FIG. 2 and with the rotor of the vibrator illustrated in section.

The housing halves 32 and 34 include smooth threaded bores 38 and 40 opening into the opposite ends thereof and the bores 38 and 40 include inner end counterbores 42 and 44 in which roller bearing assemblies 46 and 48 are seated. The housing halves 32 and 34 define halves 50 and 52 of the cavity 36 and the adjacent ends of the housing halves 32 and 34 compressively engage a gasket 54 therebetween, the housing halves 32 and 34 being secured together by means of bolts 56 passed through the housing half 32 and threadedly engaged in the housing half 34. In addition, the adjacent ends of the housing halves 32 and 34 include cylindrical relieved portions 58 and 60 in which a ramp ring 62 is seated. The ramp ring 62 includes circumferentially extending inner peripheral departure and approach ramp surfaces 64 and 66 extending circumferentially thereabout. The departure ramp surface 64 extends from the point 68 counterclockwise about the cavity 36, as viewed in FIG. 3 of the drawings, to the point 70 and the approach ramp surface 66 extends counterclockwise from the point 70 to the point 68.

The vibrator 18 includes a rotor body 72, including opposite end stub shaft portions 74 and 76 and a longitudinal bore 77 extending therethrough and opening outwardly of the stub shaft portions 74 and 76. The stub shaft portions 74 and 76 are journaled from the bearings 46 and 48 and the outer end of the bore 36 includes a counterbore 78 in which the end circumferential flange 80 of a fluid pressure inlet tube or pipe 90 is seated. A retaining plate 92 is secured over the outer end face of the housing half 32 by means of suitable fasteners 94 and the retaining plate includes a cylindrical shoulder 96 which is received within the counterbore 78 outwardly of the flange 80.

The retaining plate 92 includes a central bore 98 formed therethrough and the outlet end of a tubular fitting 100 is secured with the bore 98 and is snugly telescoped into the adjacent end of the tube 90. The outer end of the tubular fitting 100 comprises the inlet end thereof and includes a circumferential groove 102 and the outlet end of the fluid pressure line 22 is telescoped over the grooved inlet end of the fitting 100 and clamped thereby by means of any suitable clamp 104. The rotor body 72 includes a plurality of equally angularly displaced and generally radially extending bores 106 formed therein opening outwardly of the outer periphery of the rotor body 72 and a plurality of pistons 108 are reciprical in the bores 106 and include outer end rollers 110 journaled therefrom and rollingly engaged with the departure and approach ramps 64 and 66 of the ramp ring 62. Compression springs 111 are disposed between the inner ends of the pistons 108 and a tubular shaft 112 extending through the body 72 and defining the shaft portions 74 and 76. In this maner, the springs 111 yieldingly bias the pistons 108 outwardly in their respective bores 106 toward positions with their rollers 110 rollingly engaged with the departure and approach ramps 64 and 66. The pistons 108 include circumferential grooves 113 in which piston rings 114 are seated for sealed engagement with the bores 106 and the tubular shaft 112 includes three circumferentially spaced pairs of longitudinally spaced inlet and outlet ports 116 and 118 registrable with first and second longitudinally spaced ports 120 and 122 formed in the tube 90. Further, the tube 90 includes a partition 124 between the first and second ports 120 and 122 and an annular seal 126 extending thereabout and engaged with the opposing surfaces of the bore 77 intermediate the first and second ports 120 and 122.

The threaded bore 40 has an externally threaded tubular fitting 128 threadedly engaged therein and the inlet end of the tubular fitting is provided with a closure disk 130 having a plurality of apertures 132 formed therethrough. The outlet end of the fitting 128 has the inlet end of a hose 134 connected thereto and the hose 134 is constructed of resilient material for a purpose to be hereinafter more fully set forth.

In operation, air under pressure is supplied to the vibrator 18 through the line 22 and the bores 106 containing the pistons 108 engaged with the departure ramp 64 are communicated at their inner ends with the interior of the tube 90 through the first port 120. Thus, the inner ends of those bores are pressurized and the pistons 108 therein are forced outwardly whereby they are moved about the departure ramp 64 in order to impart rotation to the rotor body 72. As the pistons 108 reach the end of the departure ramp 64, the corresponding bores 106 move out of registry with the port 120 and become registered with the port 122 whereby inward movement of the pistons 108 as they move about the approach rame 66 from the point 70 to the point 68 express the compressed air from within the bores 106 outwardly through the end of the tube 90 adjacent the fitting 128. Of course, the exhausted air enters the hose 134 through the ports or apertures 132.

Figure 8:
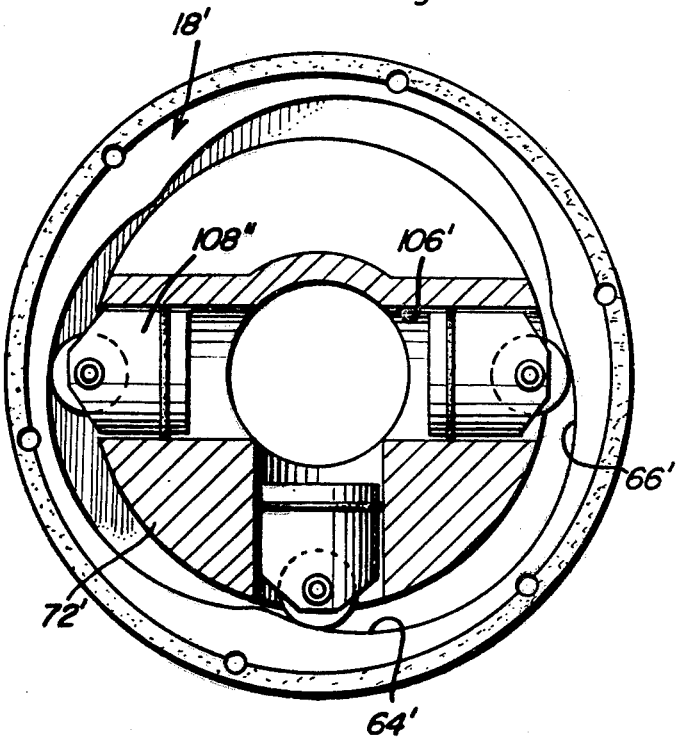
FIG. 8 is an end elevational view, similar to FIG. 3, of a modified form of vibrator.

With attention now invited to FIG. 8 of the drawings, there may be seen a modified form of vibrator referred to in general by the reference numeral 18'. The vibrator 18' is substantially identical to the vibrator 18 except that the vibrator 18' includes three departure ramps 64' and three approach ramps 66'. In addition, the rotor body 72' of the vibrator 18' includes three bores 106' and pistons 108' therefore which are arranged slightly differently from the bores 106 and pistons 108 of the rotor body 72. The bores 106' are displaced 90 degrees apart about the rotor body 72' and two of the bores 106' are displaced 180 degrees apart. The particular utilization of three pairs of departure and approach ramp surfaces 64' and 66' illustrated functions, in conjunction with the particular arrangement of the bores 106', to prevent the vibrator 18' from including "dead" positions of the rotor body 72'.

It is also to be understood that the rotor bodies 72 and 72' are eccentrically weighted so as to cause the vibrators 18 and 18' to generate considerable vibration during rotation of the rotor bodies 72 and 72' thereof at high speed.

Inasmuch as the compressed air to be exhausted from the bores 106 and 106' is mechanically expressed therefrom by inward movement of the pistons 108 and 108', the exhaust from the shaft portion 76 experiences rapid pressure pulses. Therefore, if the air being exhausted from the shaft portion 76 was allowed to escape directly into the ambient atmosphere, the vibrator 18 would generate considerable noise. However, by exhausting the exhaust air through the apertures 32, the pulses of exhausted air under pressure are greatly modulated and the discharging of the modulated exhaust air from the apertures or ports 132 into the hose 134 constructed of resilient material substantially further reduces the sound generated by the exhausting of air from the vibrator 18. The ports 132, in fact, create a slight reduction in the torque generated by the vibrator 18, but the loss of torque is negligible and is accompanied by a reduction in the volume of air passing through the vibrator 18.

Figure 9:
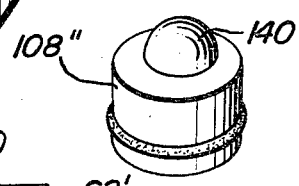
FIG. 9 is a perspective view of a modified form of piston which may be utilized in the rotary vibrator.
Figure 6:
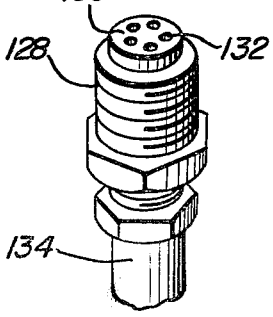
FIG. 6 is a fragmentary, perspective view of the sound muffling exhaust for the fluid actuated rotary vibrator.
Figure 10:
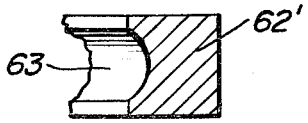
FIG. 10 is a fragmentary, radial, sectional view of a modified form of ramp ring.

With attention now invited more specifically to FIG. 9 of the drawings, there may be seen a modified form of piston referred to in general by the reference numeral 108''. The piston 108'' is substantially identical to the pistons 108 and 108', except that the outer end of the piston 108'' is provided with a convex partial spherical projection 140 which may be anchored to the piston 108'' by means of an attaching shank (not shown) pressed into a suitable recess provided therefor in the outer end of the piston 108''. The projection 140 functions in the same manner as the anti-friction rollers 110. However, when the projections 140 are utilized, a modified ramp ring 62' is also used and the inner peripheral surface thereof is radiused, as at 63, an amount corresponding to the radius of the curvature of the projection 140 and will be concave in order that the projection 140 will enjoy a line contact with the inner periphery of the ramp ring 62'.

Figure 7:
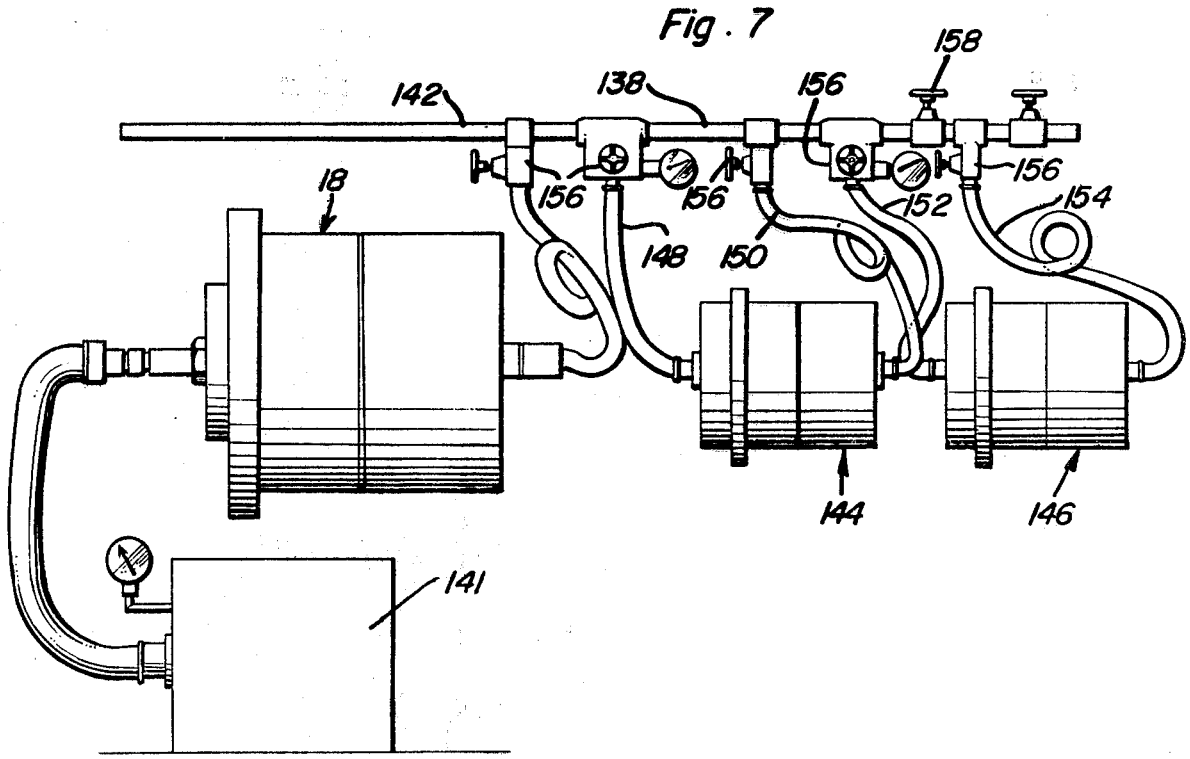
FIG. 7 is a side elevational view of a plurality of different size rotary vibrators constructed in accordance with the present invention and operatively connected in tandem.
Figure 2:
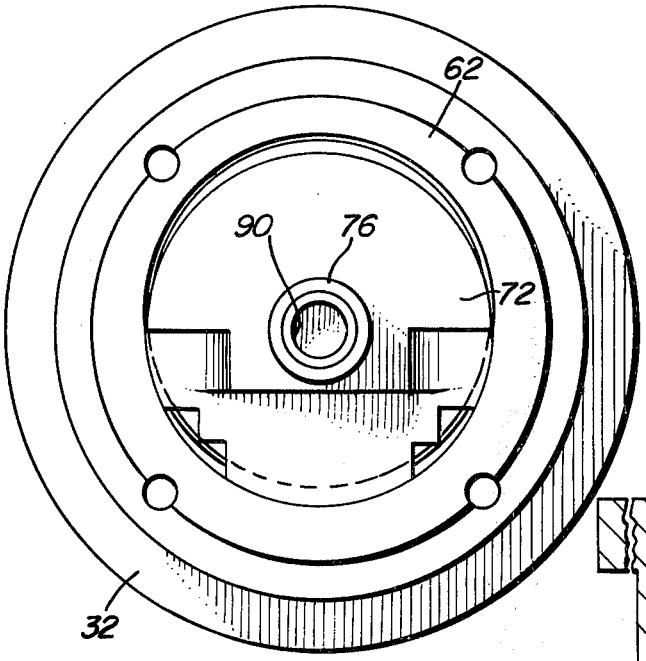
FIG. 2 is an end elevational view of the rotary vibrator with the exhaust end of the housing thereof removed.

With attention now invited more specifically to FIG. 7 of the drawings, it may be seen that a first vibrator 18 may be operatively coupled to a suitable source 141 of air under pressure and that the exhaust air from the vibrator 18 may be discharged into an exhaust manifold 142. Further, second and third vibrators 144 and 146 may be connected with the manifold 122 by means of pairs of inlet and outlet lines 148, 150 and 152, 154 with each line 148, 150, 152 and 154 being provided with a control valve 156. In addition, the manifold 142 is provided with a control valve 158 intermediate the control valves 152 and 154. In this manner, the same supply of compressed air from the source 141 may be utilized to simultaneously drive the vibrators 18, 144 and 146. Of course, if the vibrator 144 is not to be used, the valves 156 in the lines 148 and 150 thereof may be closed in order that the exhaust air from the vibrator 18 may be ducted to the vibrator 146 through the line 152. However, if the vibrators 146 and 18 are to be operated in unison during inactivity of the vibrator 144, the valve 158 is closed in order that the discharge of air from the vibrator 18 into the manifold 142 will not be able to bypass the vibrator 146. Further, an additional valve 158 is disposed between the lines 148 and 150 in the manifold 142 in the event the vibrators 18 and 144 are to be operated in unison. Of course, both valves 158 will be closed when all of the vibrators 18, 144 and 146 are to be operated in unison.

With attention again invited to FIG. 4 of the drawings, it will be appreciated that the tube 90 may be rotated in order that the ports 120 and 122 thereof may be reversed in positions. In this manner, the rotor body 72 may be caused to rotate in opposite directions. Further, the ports 120 and 122, in effect, overlap whereby as the pistons approach their innermost positions within their respective bores, the inner ends of the bores are pressurized. In this manner, it is assured that the outer ends of the pistons remain in contact with the ramp ring 62 at all times.

If it is desired, the rotor body 72 may be balanced and the shaft portion 76 may be extended through the adjacent end of the housing half 34 and have a rotary coupling mounted thereon for receiving air discharged from the vibrator 18 and the extended shaft portion 76 may also have a pulley wheel, or the like, mounted thereon externally of the housing 30 whereby the rotor may be utilized as a source of rotary torque for driving a selected apparatus requiring the input of rotary torque. In this manner, the vibrator 18 may be converted to a fluid motor.

Inasmuch as the vibrator 18 functions to pump the exhaust air therefrom, a considerable portion of the original pressure of the actuating air is maintained. Accordingly, the exhaust from the vibrator 18 may readily drive the vibrator 144 and the exhaust from the vibrator 144 may readily drive the vibrator 146. Also, the rotor body 72 may be provided with replaceable weights whereby the eccentric weighting of the rotor body 72 may be varied. Inasmuch as the rotor body 72 will spin at reasonably high speeds during operation of the vibrator 18, the compression springs 111 may be omitted, if desired. The centrifugal force acting upon the pistons 108 will provide appreciable yieldable force upon the pistons 108 to bias them outwardly toward the outer ends of the corresponding bores 106.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a fluid motor including a housing defined by a pair of housing end halves removably secured together, said halves having aligned bores formed therethrough including first enlarged counterbores opening toward each other, enlarged cavity halves formed in the adjacent portions of said housing halves into which the adjacent ends of said counterbores open, second enlarged counterbores formed in and opening outwardly through the adjacent portions of said halves comprising enlargements of the adjacent ends of said cavity halves, a pair of bearings in said first counterbores, a tubular shaft having a longitudinal bore formed therethrough and its opposite ends journaled from said bearings, an eccentrically weighted rotor mounted on said tubular shaft for rotation therewith and disposed between said bearings and within said cavity halves, said rotor having at least one piston bore formed therein extending generally radially of the axis of rotation of said rotor and opening outwardly of the periphery of said rotor, a ramp ring mounted between said housing halves in said second counterbores and defining at least one pair of approach and departure ramp surfaces extending thereabout in registry with which the outer end of said bore swings on rotation of said rotor in said cavity halves, a piston receptacle in said bore, said piston including thrust transfer surface means rollingly engaged with said ramp surfaces, inlet and outlet means operative to admit fluid under pressure into the inner end of said bore and to exhaust fluid from the inner end of said bore in timed relation with rotation of said rotor as said thrust transfer surface means rolls into position for rolling engagement with said departure and approach ramp surfaces, respectively, a stationary fluid pressure tube having one end portion rotatably and telescopingly received in one end portion of said tubular shaft and the other end removably stationarily received within the corresponding housing half bore, said tube including a partition therein intermediate its opposite ends and outwardly opening first and second ports formed therein on opposite sides of said partition, inlet and exhaust ports in said rotor opening into the inner end of said piston bore at one pair of corresponding ends and swingable into an out of registry with said first and second ports, respectively, at the other pair of corresponding ends thereof upon rotation of said rotor, said inlet means including means operative to admit fluid under pressure into the other end portion of said fluid pressure tube on the first port side of said partition and said outlet means including exhaust means for exhausting fluid under pressure from said one end portion of said fluid pressure tube on the second port side of said partition, said exhaust means comprising said other housing half bore with which said one end portion of said fluid pressure tube is registered, and seal means forming a fluid seal between the external surfaces of said tube and the opposing surfaces of said longitudinal bore intermediate said first and second ports.

2. The combination of claim 1, including spring means operatively connected between said piston and rotor yieldingly biasing said piston outwardly in said bore.

3. The combination of claim 1, wherein said anti-friction thrust means includes roller means journaled from the outer end of said piston and rollingly engaged with said ramp surfaces.

4. The combination of claim 1, wherein said anti-friction thrust means includes an outwardly convex partial spherical projection on the outer end of said piston slidingly engaged with said ramp surfaces, said ramp surfaces being transversely radiused.

5. The combination of claim 1, wherein said first and second ports are disposed in substantially diametrically opposite side portions of said tube, said tube being angularly positionable about its longitudinal axis relative to said housing through an arc of substantially 180 degrees.

6. The combination of claim 1 including an elongated tube constructed of resilient material having one end thereof sealingly communicated with the last mentioned bore and including an apertured partition disposed across said one end thereof.

7. The combination of claim 1, wherein said rotor includes three substantially equally angularly displaced piston bores and pistons reciprocal therein.

8. The combination of claim 7, wherein said ramp surfaces each are of generally 180 degrees in angular extent.

9. The combination of claim 1, wherein said rotor includes three piston bores, two of said piston bores being relatively angularly displaced substantially 180 degrees and the third of said bores being angularly displaced generally 90 degrees relative to each of said two bores.

10. The combination of claim 9, wherein said means defining said approach and departure ramp surfaces defines three pairs of departure and ramp surfaces alternately spaced about said cavity.

11. The combination of claim 9, wherein each of said ramp surfaces is generally 60 degrees in angular extent.

12. The combination of claim 1, including a plurality of said motors, and means communicating the gas outlet means of one motor with the inlet means of a second motor.

13. The combination of claim 12, wherein said motors include a third motor with whose inlet means the outlet means of said second motor is communicated.

* * * * *